US006912864B2

(12) United States Patent
Roche et al.

(10) Patent No.: US 6,912,864 B2
(45) Date of Patent: Jul. 5, 2005

(54) EVAPORATOR FOR REFRIGERATED MERCHANDISERS

(75) Inventors: John Roche, Ballwin, MO (US); Clay Rohrer, Belle, MO (US)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 10/683,034

(22) Filed: Oct. 10, 2003

(65) Prior Publication Data

US 2005/0076662 A1 Apr. 14, 2005

(51) Int. Cl.[7] ..... A47F 3/04
(52) U.S. Cl. ..... 62/256; 62/515
(58) Field of Search ..... 62/256, 419, 426

(56) References Cited

U.S. PATENT DOCUMENTS

| | | | | | |
|---|---|---|---|---|---|
| 1,845,888 | A | | 2/1932 | Rutishauser | |
| 2,181,637 | A | | 11/1939 | Ardito | |
| 3,218,822 | A | * | 11/1965 | Bently et al. | 62/256 |
| 3,289,432 | A | * | 12/1966 | Brennan et al. | 62/256 |
| 3,303,666 | A | * | 2/1967 | Toper | 62/426 |
| 3,397,631 | A | * | 8/1968 | Simons | 454/190 |
| 3,524,328 | A | * | 8/1970 | Schuster | 62/285 |
| 3,628,590 | A | | 12/1971 | Knebush | |
| 3,696,630 | A | | 10/1972 | Bressickello | |
| 3,741,290 | A | | 6/1973 | Nenadal | |
| 3,850,003 | A | | 11/1974 | Beckwith et al. | |
| 4,145,893 | A | | 3/1979 | Vogel | |
| 4,474,232 | A | | 10/1984 | Wright et al. | |
| 4,958,504 | A | * | 9/1990 | Ichikawa et al. | 62/244 |
| 5,121,613 | A | * | 6/1992 | Cox et al. | 62/419 |
| 5,157,941 | A | | 10/1992 | Cur et al. | |
| 5,279,360 | A | | 1/1994 | Hughes et al. | |
| 5,329,988 | A | | 7/1994 | Juger | |
| 5,564,497 | A | | 10/1996 | Fukuoka et al. | |
| 5,579,649 | A | * | 12/1996 | Kim | 62/239 |
| 5,713,215 | A | * | 2/1998 | Choi | 62/455 |
| 5,765,393 | A | * | 6/1998 | Shlak et al. | 62/507 |
| 5,901,565 | A | | 5/1999 | Morton, Jr. | |
| 5,924,297 | A | | 7/1999 | Wolff et al. | |
| 6,161,616 | A | | 12/2000 | Haussmann | |
| 6,301,916 | B1 | | 10/2001 | Navarro | |
| 6,318,109 | B1 | * | 11/2001 | Reimann et al. | 62/317 |

(Continued)

FOREIGN PATENT DOCUMENTS

| | | |
|---|---|---|
| EP | 0 710 811 | 5/1996 |

(Continued)

*Primary Examiner*—William E. Tapolcai
(74) *Attorney, Agent, or Firm*—Michael Best & Friedrich LLP

(57) ABSTRACT

A refrigerated merchandiser includes a case defining a product display area and an air passage separate from the product display area. The case includes a rear wall separating in part the product display area from a vertical portion of the air passage. The rear wall includes apertures near a lower portion of the product display area. The apertures communicate between the vertical portion of the air passage and the lower portion of the product display area. The refrigerated merchandiser also includes a fan positioned in the air passage to generate an airflow through the passage and an evaporator positioned in the vertical portion of the air passage adjacent the rear wall and at an oblique angle to allow the airflow to pass through the evaporator, through the apertures, and into the lower portion of the product display area.

43 Claims, 4 Drawing Sheets

U.S. PATENT DOCUMENTS

| | | | |
|---|---|---|---|
| 6,351,964 | B1 | 3/2002 | Brancheau et al. |
| RE37,630 | E | 4/2002 | Behr |
| 6,411,916 | B1 | 6/2002 | Pellerin |
| 6,460,372 | B1 | 10/2002 | Fung et al. |
| 2001/0003248 | A1 | 6/2001 | Otto et al. |
| 2002/0162346 | A1 | 11/2002 | Chiang et al. |
| 2002/0179295 | A1 | 12/2002 | Palanchon |

FOREIGN PATENT DOCUMENTS

| | | |
|---|---|---|
| GB | 1 497 935 | 1/1978 |
| GB | 2 198 220 | 6/1988 |
| GB | 2 227 302 | 7/1990 |
| JP | 4-263776 | 9/1992 |

* cited by examiner

EVAPORATOR FOR REFRIGERATED MERCHANDISERS

FIELD OF THE INVENTION

This invention relates generally to refrigerated merchandisers, and more particularly to medium-temperature refrigerated merchandisers.

BACKGROUND OF THE INVENTION

In conventional practice, supermarkets and convenience stores are equipped with refrigerated merchandisers, which may be open or provided with doors, for presenting fresh food or beverages to customers while maintaining the fresh food and beverages in a refrigerated environment. Typically, cold, moisture-bearing air is provided to a product display area of the merchandiser by passing an airflow over the heat exchange surface of an evaporator coil, or evaporator. A suitable refrigerant is passed through the evaporator, and as the refrigerant evaporates while passing through the evaporator, heat is absorbed from the air passing through the evaporator. As a result, the temperature of the air passing through the evaporator is lowered for introduction into the product display area of the merchandiser.

Such a prior-art refrigerated merchandiser 10 is shown in FIG. 1. The merchandiser 10 includes a case 14 generally defining an interior bottom wall 18, an interior rear wall 22, and an interior top wall 26. The area bounded by the interior bottom wall 18, interior rear wall 22, and the interior top wall 26 defines a product display area 30, in which the fresh food and/or beverages are stored on one or more shelves 32. The case 14 includes an open front face to allow customers access to the fresh food and/or beverages stored in the case 14.

The case 14 also generally defines an exterior bottom wall 34 adjacent the interior bottom wall 18, an exterior rear wall 38 adjacent the interior rear wall 22, and an exterior top wall 42 adjacent the interior top wall 26. A lower flue 46 is defined between the interior and exterior bottom walls 18, 34 to allow for substantially horizontal airflow throughout the lower flue 46. The interior bottom wall 18 includes an opening 50 to communicate with the lower flue 46 to allow surrounding air to be drawn into the lower flue 46. A rear flue 54 is defined between the interior and exterior rear walls 22, 38 and is fluidly connected with and adjacent to the lower flue 46. The rear flue 54 allows for substantially vertical airflow throughout the rear flue 54. An upper flue 58 is defined between the interior and exterior top walls 26, 42 and is fluidly connected with and adjacent to the rear flue 54. The upper flue 58 allows for substantially horizontal airflow throughout the upper flue 58. The interior top wall 26 includes an opening 62 to communicate with the upper flue 58 to allow airflow in the upper flue 58 to be discharged from the upper flue 58. When combined, the lower flue 46, the rear flue 54, and the upper flue 58 comprise an air passage separate from the product display area 30.

The refrigerated merchandiser 10 also includes some components of a refrigeration system (not entirely shown) therein. One or more fans 66 are located within the lower flue 46 toward the back of the case 14 to generate an airflow through the lower, rear, and upper flues 46, 54, 58. A conventional round-tube plate-fin evaporator 70 is located within the rear flue 54 toward the bottom of the case 14. The evaporator 70 is positioned downstream of the fans 66 such that the airflow generated by the fans 66 passes through the evaporator 70. The fans 66 may also be positioned upstream of the evaporator 70. The refrigeration system may also include other components (not shown), such as one or more compressors, one or more condensers, a receiver, and one or more expansion valves, all of which may be remotely located from the refrigerated merchandiser 10.

The evaporator 70 is configured to receive a liquid refrigerant from the receiver. As is known in the art, the liquid refrigerant is evaporated as it passes through the evaporator 70 as a result of absorbing heat from the airflow passing through the evaporator 70. Consequently, the temperature of the airflow passing through the evaporator 70 decreases as it passes through the evaporator 70. The heated, or gaseous refrigerant then exits the evaporator 70 and is pumped back to the remotely located compressor(s) for re-processing into the refrigeration system.

With reference to FIG. 1, the interior rear wall 22 includes a plurality of apertures 74 formed therein. The apertures 74 are centrally located in the interior rear wall 22, and fluidly connect the product display area 30 and the rear flue 54. The apertures 74 allow some of the refrigerated air in the rear flue 54 to exit the rear flue 54 and enter the product display area 30. Products located in the product display area 30 may then be cooled by the refrigerated air.

The remaining portion of the refrigerated airflow that does not pass through the apertures 74 is routed vertically through the rear flue 54, and horizontally through the upper flue 58 before being discharged from the upper flue 58 via the opening 62 in the interior top wall 26. After being discharged from the opening 62 in the interior top wall 26, the refrigerated airflow moves downwardly along the open front face of the refrigerated merchandiser 10 before being drawn back into the opening 50 in the interior bottom wall 18 for re-use by the fans 66. This portion of the refrigerated airflow is known in the art as an air curtain 78. The air curtain 78, among other things, helps maintain the air temperature in the product display area 30 within a standard temperature range of 32° F. to 41° F. determined by the Food and Drug Administration ("FDA") Food Code for potentially hazardous foods.

As shown in FIG. 1, the size of the conventional round-tube plate-fin evaporator 70 often requires the fans 66 to be positioned in the lower flue 46 beneath the product display area 30. As a result, the fans 66 occupy valuable space in the merchandiser 10 that could otherwise be used for storing additional food and/or beverage products. Further, spilled product from the product display area 30 may come into contact with the fans 66, thus making cleanup of the merchandiser 10 more difficult.

Also, in some prior-art refrigeration cases (not shown), the evaporator is located in the lower flue along with the fans beneath the product display area of the merchandiser. As a result, complex ducting structure is usually required in the rear flue to route the airflow passing through the evaporator to different regions within the product display area. Also, spilled products from the product display area may come into contact with the evaporator, thus making cleanup of the merchandiser more difficult.

In conventional practice, evaporators 70 utilized in medium-temperature refrigeration merchandisers 10, such as those commonly used for displaying produce, meats, milk and other dairy products, or beverages in general, generally operate with refrigerant temperatures well below the freezing point of water (i.e., 32° F.). Further, the airflow generally exits the evaporators 70 at a temperature below the freezing point of water. Thus, during operation of the merchandisers 10, frost often forms on the evaporators 70 as a result of moisture in the air condensing onto the evaporator 70 and freezing.

Such medium-temperature refrigerated merchandisers 10 operate in this manner because the refrigerated products, like produce, meats, and dairy products, must be maintained in an environment whereby the temperature is maintained in the 32° F. to 41° F. range determined by the FDA. For the prior-art merchandisers 10 to achieve these temperatures in their product display areas 30, the refrigerant passing through the conventional round-tube plate-fin evaporators 70 is maintained at a saturation temperature of about 24° F. The resultant airflow passing through the evaporator 70 is cooled to about 31° F. At these outlet temperatures, moisture in the airflow will condense out of the airflow, settle on the evaporator 70, and freeze since the evaporator 70 is maintained at a temperature below the freezing point of water, thus leading to the build-up of frost on the evaporator 70. As frost builds up on the evaporator 70, the performance of the evaporator 70 deteriorates, and the free flow of air through the evaporator 70 becomes restricted and in extreme cases halted.

The conventional round-tube plate-fin evaporators 70 characteristically have a low fin density, typically in the range of 2 to 4 fins per inch. This practice arises in anticipation of the buildup of frost of the surface of the evaporator 70 and the desire to extend the period between required defrosting operations. As frost builds up, the effective flow space for air to pass between neighboring fins becomes progressively less and less until, in the extreme case, the space is bridged with frost. As a consequence of frost buildup, the evaporator's performance decreases, and the flow of adequately refrigerated air to the product display area 30 decreases, thus necessitating activation of a defrost operation. Typically, several defrost operations are required per day to eliminate the accumulated frost on the evaporator 70. Performing the defrost operations may be detrimental to the food and/or beverage products, since the products may be allowed to warm-up to a temperature above the 32° F. to 41° F. temperature range determined by the FDA. Defrosting the evaporator 70 also typically results in increased energy expenditures, since a relatively large amount of energy is required to initially "pull down" the air temperature in the product display area 30 after a defrost operation to an acceptable temperature within the 32° F. to 41° F. range.

As a result of their inherent inefficiencies, conventional round-tube plate-fin evaporators 70 are often physically large, and are often mounted in the merchandiser 10 such that the airflow passing through the evaporator 70 is required to pass through the evaporator 70 in a direction coinciding with a major dimension (i.e., the length or height) of the evaporator 70 to achieve the desired airflow temperature exiting the evaporator 70 and the desired air temperature in the product display area 30 of the merchandiser 10. The airflow is passed through the evaporator 70 in a direction coinciding with the major dimension to allow the evaporator 70 sufficient time to remove enough heat from the airflow to cool the airflow to a temperature of about 31° F. Further, the apertures 74 in the interior rear wall 22 are required to be centrally located, since the height of the evaporator 70 dictates the location of the apertures 74. This prevents refrigerated air from reaching products situated in a lower portion 80 of the product display area 30.

SUMMARY OF THE INVENTION

The present invention provides, in one aspect, a refrigerated merchandiser including a case defining a product display area and an air passage separate from the product display area. The case includes a rear wall separating in part the product display area from a vertical portion of the air passage. The rear wall includes apertures near a lower portion of the product display area. The apertures communicate between the vertical portion of the air passage and the lower portion of the product display area. The refrigerated merchandiser also includes a fan positioned in the air passage to generate an airflow through the passage, and an evaporator positioned in the vertical portion of the air passage adjacent the rear wall and at an oblique angle relative to a vertical axis defined by the vertical portion of the air passage to allow the airflow to pass through the evaporator, through the apertures, and into the lower portion of the product display area.

The present invention provides, in another aspect, a refrigerated merchandiser including a case defining a product display area and an air passage separate from the product display area. The case includes a rear wall separating in part the product display area from the air passage. The refrigerated merchandiser also includes a fan positioned in the air passage to generate an airflow through the passage, and a flat-tube evaporator positioned in the passage to receive the airflow from the fan. The flat-tube evaporator is configured to cool the airflow.

The present invention provides, in yet another aspect, a refrigerated merchandiser including a case defining a product display area and an air passage separate from the product display area. The case includes a rear wall separating in part the product display area from the air passage. The refrigerated merchandiser also includes a fan positioned in the air passage to generate an airflow through the air passage, and an evaporator defining a major dimension and a minor dimension. The evaporator is positioned in the air passage behind the rear wall such that the airflow passes through the evaporator in a direction coinciding with the minor dimension.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1:
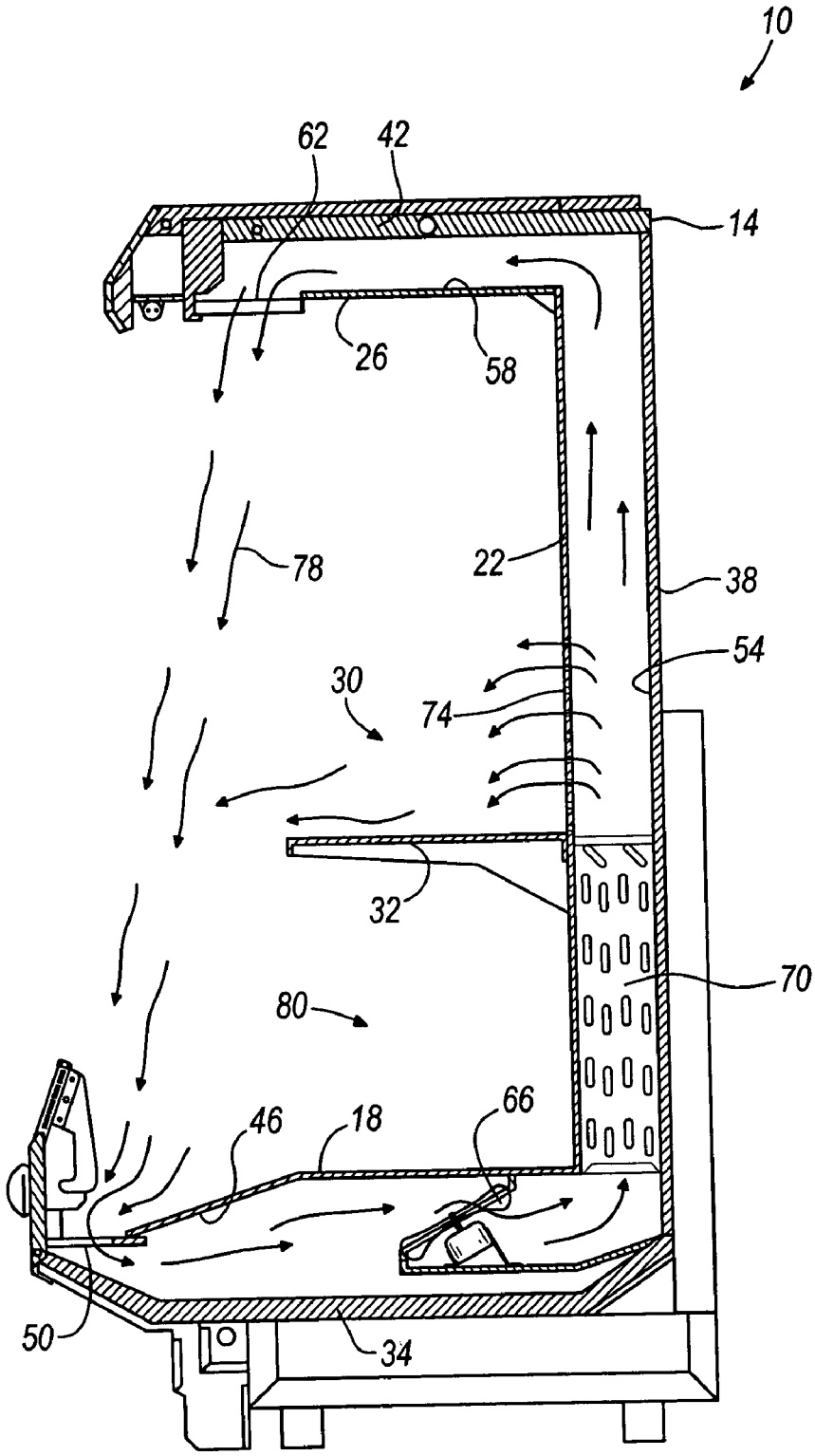
FIG. 1 PRIOR ART
FIG. 1 is a cross-sectional side view of a prior-art refrigerated merchandiser, exposing a conventional round-tube plate-fin evaporator positioned in an air passage toward the rear of the merchandiser.

Before any features of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 2:
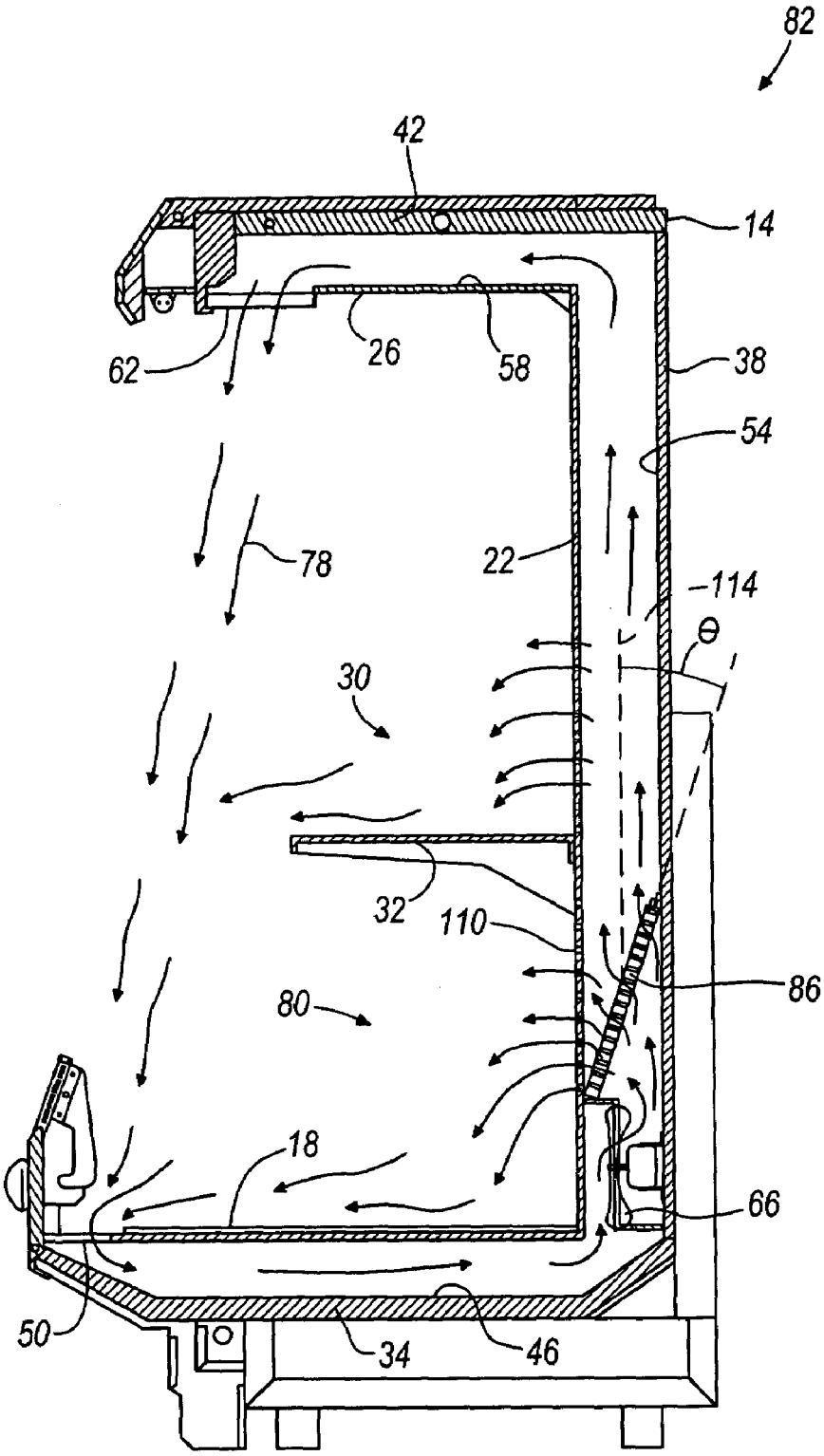
FIG. 2 is a cross-sectional side view of a refrigerated merchandiser of the present invention, exposing an evaporator positioned in an air passage toward the rear of the merchandiser.
Figure 3:
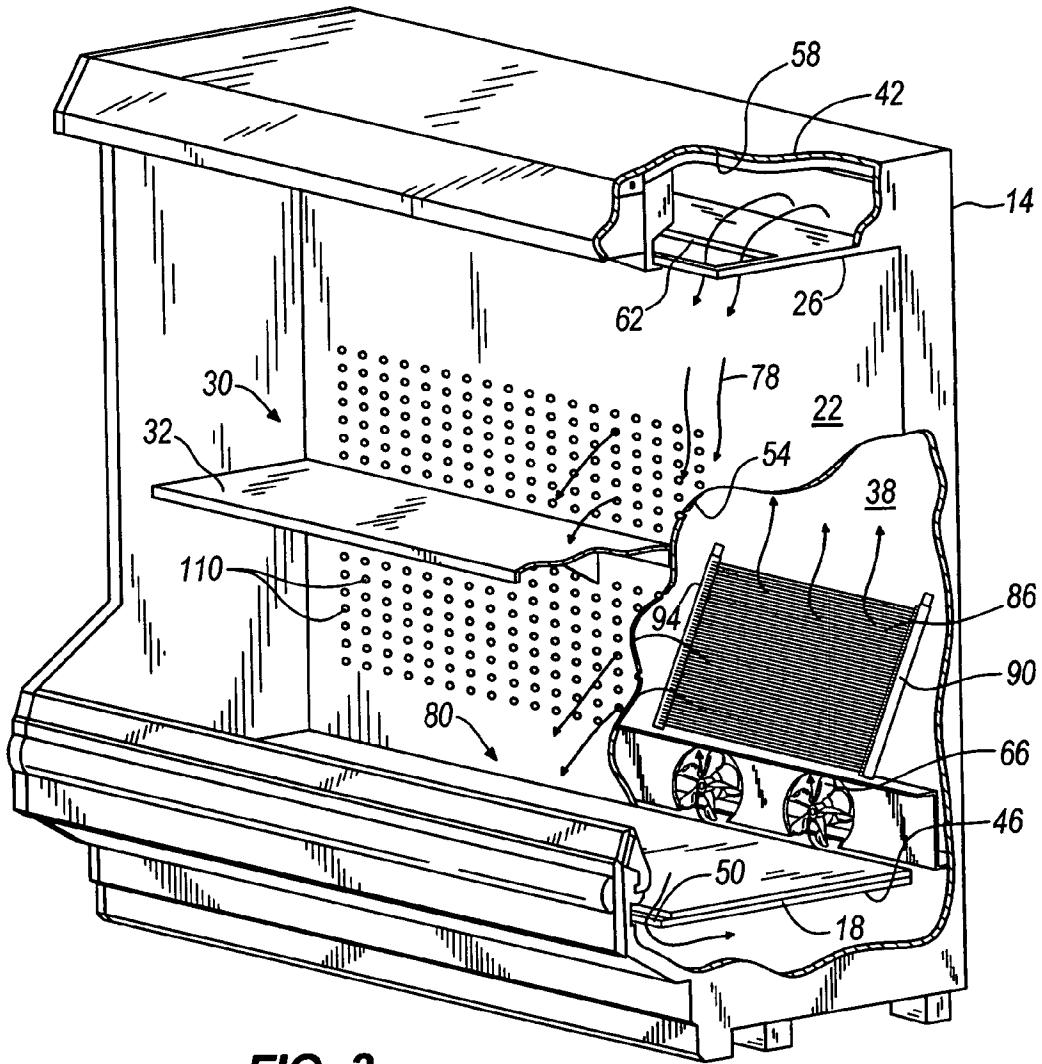
FIG. 3 is a partial perspective view of the merchandiser of FIG. 2, with portions being cut away to view the evaporator in the air passage.

With reference to FIGS. 2–3, a modified medium-temperature refrigerated merchandiser 82 is shown. Such a merchandiser 82 may be located in a supermarket or a convenience store for presenting fresh food and/or beverages to customers. Some of the components of the merchandiser 82 of FIGS. 2–3 are similar to those of the merchandiser 10 of FIG. 1, as such, like components will be labeled with like reference numerals and will not be further discussed.

The modified merchandiser 82 utilizes a flat-tube evaporator 86, rather than the conventional round-tube plate-fin evaporator 70. As used herein, the flat-tube evaporator 86 is not limited to using a two-phase refrigerant, such as ammonia. Further, the flat-tube evaporator 86 may also be used as a heat exchanger using a single-phase refrigerant, such as glycol, to absorb heat from the airflow passing through the evaporator 86. The evaporator 86 can be a single evaporator extending the length of the merchandiser 82 or it can be multiple modular evaporators that are connected together to extend the length of the merchandiser 82 as described in Hussmann's U.S. Reissue Pat. No. RE37,630 (Entitled REFRIGERATED MERCHANDISER WITH MODULAR EVAPORATOR COILS AND EEPR CONTROL).

Generally, the flat-tube evaporator 86 offers better performance than the conventional round-tube plate-fin evaporator 70. For example, the flat-tube evaporator 86 can achieve a refrigerant-side pressure drop as low as about 0.67 psi, compared to the 2 psi refrigerant-side pressure drop of the conventional round-tube plate-fin evaporator 70. A lower refrigerant-side pressure drop allows the refrigerant to more easily move throughout the evaporator 86. Also, the flat-tube evaporator 86 can achieve an air-side pressure drop as low as about 0.03 inwg (inches of water column gauge), compared to the 0.07 inwg pressure drop of the conventional round-tube plate-fin evaporator 70. A lower air-side pressure drop allows the velocity of the airflow passing through the evaporator 86 to be decreased. Further, the flat-tube evaporator 86 allows for an approach temperature as low as about 1° F. The approach temperature is defined as the difference between the temperature of the discharged airflow and the saturation temperature of the refrigerant passing through the evaporator 86. A conventional round-tube plate-fin evaporator 70 may only allow for an approach temperature as low as 7° F. However, in other constructions of the merchandiser 82, a high-performance round-tube plate-fin evaporator (e.g., an air conditioning coil, not shown) that matches the performance of the flat-tube evaporator 86 may also be used in the merchandiser 82.

Figure 4:
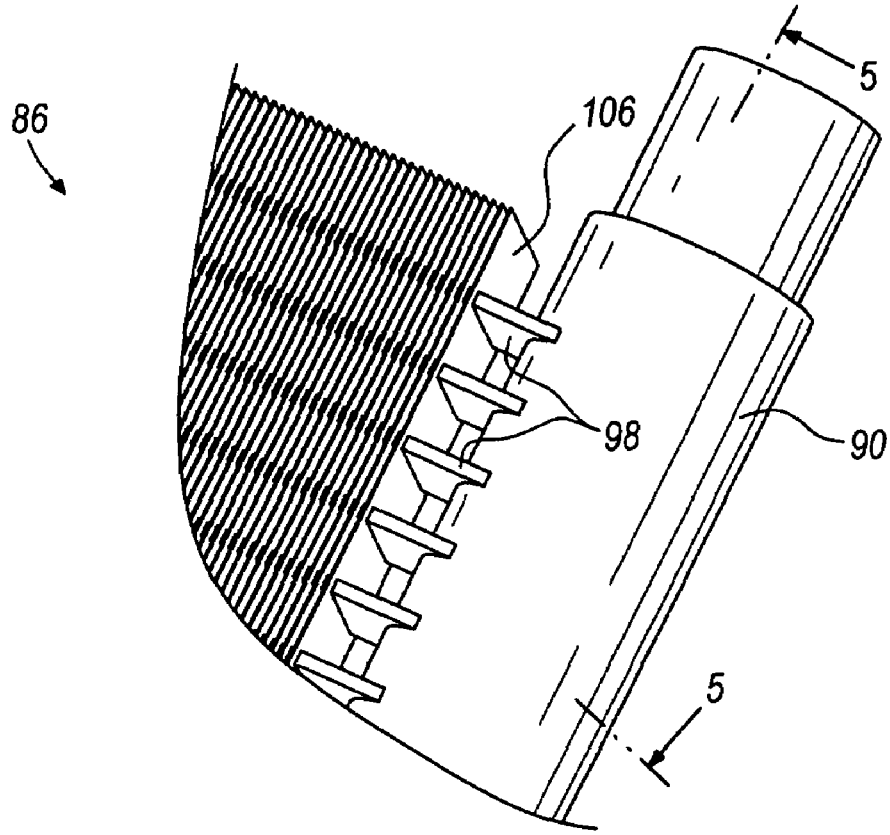
FIG. 4 is an enlarged view of a portion of the evaporator.

As shown in FIGS. 3–4, the flat-tube evaporator 86 includes an inlet manifold 90 and an outlet manifold 94 fluidly connected by a plurality of flat tubes 98. In a preferred construction of the merchandiser 82, the flat-tube evaporator 86 is positioned in the rear flue 54 such that the inlet and outlet manifolds 90, 94 are substantially horizontally-oriented and the flat tubes 98 are substantially vertically-oriented. Refrigerant maldistribution problems, in addition to condensate removal problems, are substantially alleviated by positioning the evaporator 86 in the rear flue 54 in this manner. A distributor (not shown) may also be positioned inside the inlet manifold 90 to help alleviate the refrigerant maldistribution problems.

Figure 5:
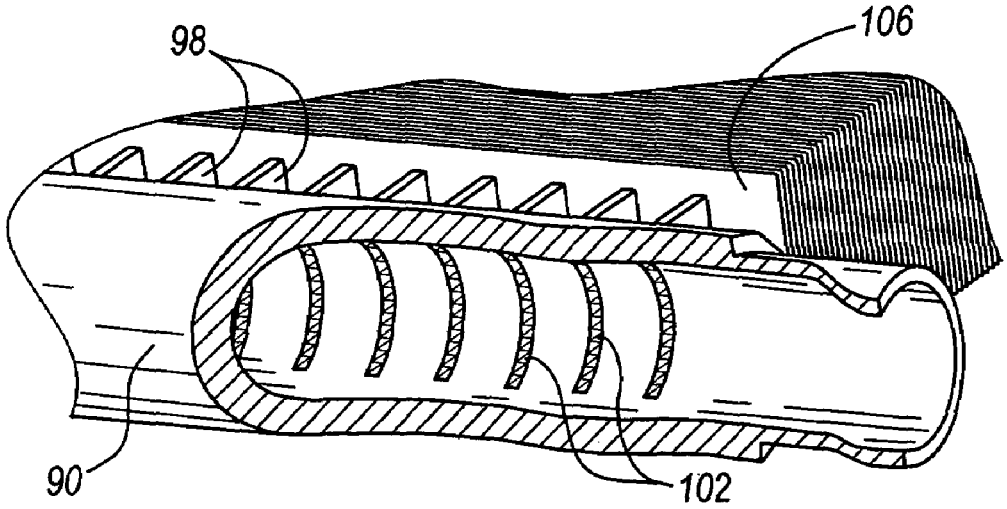
FIG. 5 is a partial section view of a portion of the evaporator of FIG. 4.

The flat-tubes 98 may be formed to include a plurality of channels, or internal passageways 102 (see FIG. 5) that are much smaller in size than the internal passageway of the coil in the conventional round-tube plate-fin evaporator 70. As used herein, the flat tubes 98 may also comprise mini multi-port tubes, or micro multi-port tubes (otherwise known as microchannel tubes). However, in other constructions of the flat tubes 98, the tubes 98 may include only one channel, or internal passageway 102. In the illustrated construction, the flat tubes 98, the inlet manifold 90, and the outlet manifold 94 are made from a highly conductive metal such as aluminum, however other highly conductive metals may also be used. Further, the flat tubes 98 are coupled to the inlet manifold 90 and the outlet manifold 94 by a brazing process, however, a welding process may also be used.

The small internal passageways 102 allow for more efficient heat transfer between the airflow passing over the flat-tubes 98 and the refrigerant carried within the internal passageways 102, compared to the airflow passing over the coil of the conventional round-tube plate-fin evaporator 70. In the illustrated construction, the internal passageways 102 are configured with rectangular cross-sections, although other constructions of the flat tubes 98 may have internal passageways 102 of other cross-sections. The flat tubes 98 are separated into about 12 to 15 passageways 102, with each passageway 102 being about 1.5 mm in height and about 1.5 mm in width, compared to a diameter of about 9.5 mm (⅜") to 12.7 mm (½") for the internal passageway of a coil in a conventional round-tube plate-fin condenser coil. However, in other constructions of the flat tubes 98, the internal passageways 102 may be as small as 0.5 mm by 0.5 mm, and as large as 4 mm by 4 mm. The flat tubes 98 may also be made from extruded aluminum to enhance the heat transfer capabilities of the flat tubes 98. In the illustrated construction, the flat-tubes 98 are about 22 mm wide. However, in other constructions, the flat tubes 98 may be as wide as 26 mm, or as narrow as 18 mm. Further, the spacing between adjacent flat tubes 98 may be about 9.5 mm. However, in other constructions, the spacing between adjacent flat tubes 98 may be as much as 16 mm, or as little as 3 mm.

As shown in FIG. 4, the flat-tube evaporator 86 includes a plurality of louver fins 106 coupled to and positioned along the flat tubes 98. The fins 106 may be coupled between adjacent flat tubes 98 by a brazing or welding process. The fins 106 are made from a highly conductive metal such as aluminum, like the flat tubes 98 and the inlet and outlet manifolds 90, 94. The brazed assembly including the flat tubes 98, the inlet and outlet manifolds 90, 94, and the fins 106 forms a brazed aluminum construction. In the illustrated construction, the louver fins 106 are configured in a V-shaped pattern and include a plurality of louvers 108 formed in the fins 106. In the illustrated construction, the fin density along the flat tubes 98 is about 16 fins per inch. However, in other constructions, the fin density along the flat tubes 98 may be as low as 6 fins per inch, and as high as 18 fins per inch. In yet other constructions, the fin density along the flat tubes 98 may be as high as 25 fins per inch.

Generally, the fins 106 aid in the heat transfer between the airflow passing through the flat-tube evaporator 86 and the refrigerant carried by the flat-tubes 98. The increased efficiency of the flat-tube evaporator 86 is due in part to such a high fin density, compared to the fin density of 2 to 4 fins per inch of the conventional round-tube plate-fin evaporator 70. The increased efficiency of the flat-tube evaporator 86 is also due in part to the louvers 108, which provide a plurality of leading edges to redirect the airflow through and around the fins 106. As a result, heat transfer between the fins 106 and the airflow is increased. Further, the high air-side heat transfer of the louver fins 106 and the high refrigerant-side heat transfer of the flat tubes 98, along with minimal contact resistance of the brazed aluminum construction, yields the highly efficient, and high-performance flat-tube evaporator 86.

The increased efficiency of the flat-tube evaporator 86, compared to the conventional round-tube plate-fin evaporator 70, allows the flat-tube evaporator 86 to be physically much smaller than the round-tube plate-fin evaporator 70. As a result, the flat-tube evaporator 86 is not nearly as tall, and is not nearly as wide (or thick) as the conventional round-tube plate-fin evaporator 70. Further, apertures 110 may be formed in the interior rear wall 22 much closer to the lower portion 80 of the product display area 30. The apertures 110 are located toward the bottom of the interior rear wall 22, and fluidly connect the lower portion 80 of the product display area 30 with the rear flue 54. The apertures 110 allow some of the refrigerated air in the rear flue 54 to exit the rear flue 54 and enter the lower portion 80 of the product display area 30. Products situated in the lower portion 80 of the product display area 30, that otherwise would not receive much of the refrigerated air in the prior-art merchandiser 10, may then be cooled by the refrigerated air.

As shown in FIG. 2, the evaporator 86 is positioned in the rear flue 54 and tilted at an oblique angle θ relative to a vertical axis 114 passing through the rear flue 54. The evaporator 86 is able to be tilted because it is physically much smaller in size than the conventional round-tube plate-fin evaporator 70, which is oriented an upright manner and occupies the entire width of the rear flue 54 of the prior-art merchandiser 10. However, in other constructions, the evaporator 86 may be positioned in the rear flue 54 substantially vertically or parallel with the rear flue 54 such that the airflow passes substantially horizontally through the evaporator 86.

By tilting the evaporator 86 as shown in FIG. 2, a greater amount of refrigerated air may be allowed to exit the evaporator 86, pass through the apertures 110, and enter the lower portion 80 of the product display area 30 to cool products situated therein. As a result, complex ducting structure for redirecting the refrigerated airflow downwardly to the lower portion 80 of the product display area 30 that is normally associated with some conventional refrigerated merchandisers is no longer required. In the illustrated construction, the evaporator 86 is tilted at an angle θ relative to the vertical axis 114 about 11 degrees. However, in other constructions of the merchandiser 82, the evaporator 86 may be tilted at an angle θ relative to the vertical axis 114 between about 5 degrees and 15 degrees. The portion of the refrigerated airflow that does not enter into the lower portion 80 of the product display area 30 moves upwardly to be discharged as the air curtain 78, as previously discussed.

As a result of using the flat-tube evaporator 86, the fans 66 are allowed to be relocated from the lower flue 46 to the rear flue 54. This is allowed because the height of the flat-tube evaporator 86 is much less than that of the conventional round-tube plate-fin evaporator 70. By doing this, the space ordinarily occupied by the fans 66 may now be freed up to store more food and/or beverage products in the lower portion 80 of the product display area 30. Further, relocating the fans 66 to the rear flue 54 substantially prevents spilled products from coming into contact with the fans 66, thus simplifying cleanup of the merchandiser 82. However, in other constructions of the merchandiser 82, the fans 66 may remain in the lower flue 46 as shown in FIG. 1. As a result, the flat-tube evaporator 86 may be lowered even further such that the flat-tube evaporator 86 may be positioned directly behind the lowest food and/or beverage products in the lower portion 80 of the product display area 30.

The increased efficiency of the flat-tube evaporator 86 compared to a conventional round-tube plate-fin evaporator 70 also allows for "wet operation" of the evaporator, while maintaining the FDA standard 32° F. to 41° F. temperature range within the product display area 30. Conventional round-tube plate-fin evaporators 70, because of their relatively poor efficiency, only allow for "frosted operation," in which the saturation temperature of the refrigerant passed through the round-tube plate-fin evaporator 70 is maintained at about 24° F. The airflow passing through the round-tube plate-fin evaporator 70 is cooled to about 31° F., which is below the freezing point of water. At these outlet temperatures, moisture in the airflow will condense out of the airflow, settle on the evaporator 70, and freeze since the evaporator 70 is maintained at a temperature below the freezing point of water, thus leading to the build-up of frost on the evaporator 70.

The conventional round-tube plate-fin evaporators 70 often need to discharge the airflow at such low temperatures to maintain a temperature in the product display area 30 that is near the lower limit of the FDA determined 32° F. to 41° F. temperature range. This is to accommodate for the multiple defrost operations that occur during the course of the day. By providing refrigerated air to the product display area 30 at a temperature of about 31° F., more time is available to defrost the evaporator 70 while the product display area 30 warms up. Since the food and/or beverage products are maintained at a temperature at or near about 31° F., the defrost operation should be completed before the temperature of the food and/or beverage products warms up to about 41° F., which is the upper limit of the FDA determined temperature range.

The increased efficiency of the flat-tube evaporator 86 allows for "wet operation," in which the saturation temperature of the refrigerant passing through the flat-tube evaporator 86 is maintained at about 32° F. to cool the airflow passing through the flat-tube evaporator 86 to about 33° F., which is above the freezing point of water. This is allowed as a result of moving the airflow at a relatively low velocity, compared to conventional merchandisers 10, over the large heat transfer surface or face of the flat-tube evaporator 86.

The saturation temperature of the refrigerant may also be lowered (to as low as 30° F., without frosting) to cool the airflow passing through the flat-tube evaporator 86 below 33° F. At these discharge temperatures, moisture in the airflow will condense out of the airflow, and settle on the evaporator 86 as water droplets. Since the water droplets will not freeze, frost build-up on the evaporator 86 will be substantially prevented, thus eliminating defrost operations entirely. Further, the performance of the evaporator 86 will not decrease during periods of operation. The water droplets may fall into and be collected in a drain (not shown) below the evaporator 86, which would otherwise be used for collecting water droplets during a defrost operation.

As previously described, some of the refrigerated airflow discharged from the flat-tube evaporator 86 is allowed directly into the product display area 30. Since defrost operations are not required when using the flat-tube evaporator 86, the refrigerated air exiting the evaporator 86 and entering the product display area 30 may be raised from 31°

F. to 33° F. As such, the food and/or beverage products in the product display area 30 may be maintained well within the FDA determined 32° F. to 41° F. temperature range since temperature fluctuations due to defrost operations are eliminated. Further, increasing the saturation temperature of the refrigerant from 24° F. to 32° F. allows for a decreased energy consumption by the compressor, and eliminating the defrost operations allows for additional energy savings by eliminating the initial "pull down" loads after completing a defrost operation.

The increased efficiency of the flat-tube evaporator 86 also allows the airflow to be directed over the minor dimension of the evaporator 86 (the width or thickness dimension) as opposed to the major dimension of the evaporator 86 (the height or length dimension). This is possible since the flat-tube evaporator 86 is allowed sufficient time to remove enough heat from the airflow to cool the airflow to the desired 33° F. discharge temperature.

What is claimed is:

1. A refrigerated merchandiser, comprising:

a medium-temperature refrigerated case defining a product display area that is maintained at a temperature between 32° F. and 41° F. and an air passage separate from the product display area, the case including a rear wall separating in part the product display area from a vertical portion of the air passage, the rear wall including apertures near a lower portion of the product display area, the apertures communicating between the vertical portion of the air passage and the lower portion of the product display area;

a fan positioned in the air passage to generate an airflow through the passage; and a flat-tube evaporator positioned in the vertical portion of the air passage adjacent the rear wall and at an oblique angle relative to a vertical axis defined by the vertical portion of the air passage to allow the airflow to pass through the evaporator, through the apertures, and into the lower portion of the product display area, the evaporator being configured for wet operation.

2. The refrigerated merchandiser of claim 1, wherein the fan is positioned upstream from the evaporator.

3. The refrigerated merchandiser of claim 1, wherein the evaporator is positioned behind the rear wall.

4. The refrigerated merchandiser of claim 1, wherein the fan is positioned behind the rear wall.

5. The refrigerated merchandiser of claim 1, wherein the evaporator is a microchannel evaporator configured to cool the airflow generated by the fan.

6. The refrigerated merchandiser of claim 5, wherein the microchannel evaporator includes a plurality of cooling fins spaced thereon between 6 and 25 fins per inch.

7. The refrigerated merchandiser of claim 1, wherein the evaporator is configured to operate at a temperature of at least 30° F. such that formation of frost on the evaporator is substantially prevented.

8. The refrigerated merchandiser of claim 1, wherein the evaporator is tilted between about 5 degrees and 15 degrees from the vertical axis.

9. The refrigerated merchandiser of claim 1, wherein the evaporator defines a major dimension and a minor dimension, the evaporator being positioned in the air passage behind the rear wall such that the airflow passes through the evaporator in a direction coinciding with the minor dimension.

10. The refrigerated merchandiser of claim 9, wherein the minor dimension coincides with a thickness dimension of the evaporator.

11. A refrigerated merchandiser, comprising:

a medium-temperature refrigerated case defining a product display area that is maintained at a temperature between 32° F. and 41° F. and an air passage separate from the product display area, the case including a rear wall separating in part the product display area from the air passage;

a fan positioned in the air passage to generate an airflow through the passage; and a flat-tube evaporator positioned in the passage to receive the airflow from the fan, the flat-tube evaporator being configured for wet operation to cool the airflow such that air discharged from the flat-tube evaporator has a temperature greater than 32° F.

12. The refrigerated merchandiser of claim 11, wherein the rear wall separates in part the product display area and a vertical portion of the air passage, and wherein the rear wall includes apertures near a lower portion of the product display area, the apertures communicating between the vertical portion of the air passage and the lower portion of the product display area.

13. The refrigerated merchandiser of claim 12, wherein the evaporator is positioned in the vertical portion of the air passage adjacent the rear wall and at an oblique angle relative to a vertical axis defined by the vertical portion of the air passage to allow the airflow to pass through the evaporator, through the apertures, and into the lower portion of the product display area.

14. The refrigerated merchandiser of claim 13, wherein the evaporator is tilted between about 5 degrees and 15 degrees from the vertical axis.

15. The refrigerated merchandiser of claim 13, wherein the evaporator is positioned behind the rear wall.

16. The refrigerated merchandiser of claim 11, wherein the fan is positioned behind the rear wall.

17. The refrigerated merchandiser of claim 11, wherein the evaporator includes a plurality of cooling fins spaced thereon between 6 and 25 fins per inch.

18. The refrigerated merchandiser of claim 11, wherein the evaporator is configured to operate at a temperature of at least 30° F. such that formation of frost on the flat-tube evaporator is substantially prevented.

19. The refrigerated merchandiser of claim 11, wherein the evaporator defines a major dimension and a minor dimension, the evaporator being positioned in the air passage behind the rear wall such that the airflow passes through the evaporator in a direction coinciding with the minor dimension.

20. The refrigerated merchandiser of claim 19, wherein the minor dimension coincides with a thickness dimension of the evaporator.

21. The refrigerated merchandiser of claim 14, wherein the flat-tube evaporator is a microchannel evaporator.

22. A refrigerated merchandiser, comprising:

a medium-temperature refrigerated case defining a product display area that is maintained at a temperature between 32° F. and 41° F. and an air passage separate from the product display area, the case including a rear wall separating in part the product display area from the air passage;

a fan positioned in the air passage to generate an airflow through the air passage; and a flat-tube evaporator defining a major dimension and a minor dimension, the evaporator being positioned in the air passage behind the rear wall such that the airflow passes through the evaporator in a direction coinciding with the minor dimension, the evaporator including a refrigerant having a saturation temperature no greater than 32° F. to cool the airflow such that air discharged from the evaporator has a temperature greater than 32° F.

23. The refrigerated merchandiser of claim 22, wherein the minor dimension coincides with a thickness dimension of the evaporator.

24. The refrigerated merchandiser of claim 22, wherein the evaporator is positioned behind the rear wall.

25. The refrigerated merchandiser of claim 22, wherein the fan is positioned behind the rear wall.

26. The refrigerated merchandiser of claim 22, wherein the rear wall separates in part the product display area and a vertical portion of the air passage, and wherein the rear wall includes apertures near a lower portion of the product display area, the apertures communicating between the vertical portion of the air passage and the lower portion of the product display area.

27. The refrigerated merchandiser of claim 26, wherein the evaporator is positioned in the vertical portion of the air passage adjacent the rear wall and at an oblique angle relative to a vertical axis defined by the vertical portion of the air passage to allow the airflow to pass through the evaporator, through the apertures, and into the lower portion of the product display area.

28. The refrigerated merchandiser of claim 27, wherein the evaporator is tilted between about 5 degrees and 15 degrees from the vertical axis.

29. The refrigerated merchandiser of claim 22, wherein the fan is positioned upstream from the evaporator.

30. The refrigerated merchandiser of claim 22, wherein the evaporator is a microchannel evaporator configured to cool the airflow generated by the fan.

31. The refrigerated merchandiser of claim 30, wherein the microchannel evaporator includes a plurality of cooling fins spaced thereon between 6 and 25 fins per inch.

32. The refrigerated merchandiser of claim 22, wherein the evaporator is configured to operate at a temperature of at least 30° F. such that formation of frost on the evaporator is substantially prevented.

33. A refrigerated merchandiser, comprising:

a medium-temperature refrigerated case defining a product display area to be maintained at a temperature between 32° F. and 41° F. and an air passage separate from the product display area, the case including a rear wall separating in part the product display area from the air passage;

a fan positioned in the air passage to generate an airflow through the passage; and a flat-tube heat-exchanger positioned in the passage to receive the airflow from the fan, the flat-tube heat-exchanger being configured to cool the airflow by using a single-phase refrigerant, the flat-tube heat-exchanger being configured for wet operation.

34. The refrigerated merchandiser of claim 33, wherein the rear wall separates in part the product display area and a vertical portion of the air passage, and wherein the rear wall includes apertures near a lower portion of the product display area, the apertures communicating between the vertical portion of the air passage and the lower portion of the product display area.

35. The refrigerated merchandiser of claim 34, wherein the heat-exchanger is positioned in the vertical portion of the air passage adjacent the rear wall and at an oblique angle relative to a vertical axis defined by the vertical portion of the air passage to allow the airflow to pass through the heat-exchanger, through the apertures, and into the lower portion of the product display area.

36. The refrigerated merchandiser of claim 35, wherein the heat-exchanger is tilted between about 5 degrees and 15 degrees from the vertical axis.

37. The refrigerated merchandiser of claim 33, wherein the heat-exchanger is positioned behind the rear wall.

38. The refrigerated merchandiser of claim 33, wherein the fan is positioned behind the rear wall.

39. The refrigerated merchandiser of claim 33, wherein the heat-exchanger includes a plurality of cooling fins spaced thereon between 6 and 25 fins per inch.

40. The refrigerated merchandiser of claim 33, wherein the heat-exchanger is configured to operate at a temperature of at least 30° F. such that formation of frost on the flat-tube heat-exchanger is substantially prevented.

41. The refrigerated merchandiser of claim 33, wherein the heat-exchanger defines a major dimension and a minor dimension, the heat-exchanger being positioned in the air passage behind the rear wall such that the airflow passes through the heat-exchanger in a direction coinciding with the minor dimension.

42. The refrigerated merchandiser of claim 41, wherein the minor dimension coincides with a thickness dimension of the heat-exchanger.

43. The refrigerated merchandiser of claim 33, wherein the flat-tube heat-exchanger is a microchannel heat-exchanger.

* * * * *